US012674335B2

(12) United States Patent
Deleu

(10) Patent No.: US 12,674,335 B2
(45) Date of Patent: Jul. 7, 2026

(54) EXHIBITION STAND

(71) Applicant: Aluvision N.V., Kortrijk (BE)

(72) Inventor: Dirk Deleu, Deinze (BE)

(73) Assignee: ALUVISION N.V., Deinze (BE)

( * ) Notice: Subject to any disclaimer, the term of this patent is extended or adjusted under 35 U.S.C. 154(b) by 137 days.

(21) Appl. No.: 18/432,683

(22) Filed: Feb. 5, 2024

(65) Prior Publication Data

US 2024/0279945 A1 Aug. 22, 2024

(30) Foreign Application Priority Data

Feb. 16, 2023 (BE) ..... 2023/5114

(51) Int. Cl.
*E04H 1/12* (2006.01)
*E04B 1/343* (2006.01)

(52) U.S. Cl.
CPC ..... *E04H 1/1272* (2013.01); *E04B 1/34384* (2013.01)

(58) Field of Classification Search
CPC ..... E04H 1/1272; E04B 1/34384
See application file for complete search history.

(56) References Cited

U.S. PATENT DOCUMENTS 4,103,465 A * 8/1978 McDonald, Jr. .... G09F 15/0068 52/475.1
5,673,531 A * 10/1997 Carcedo ..... E04H 1/1272 403/231
5,680,737 A * 10/1997 Sheipline ..... F16B 7/0453 403/205
6,179,511 B1 * 1/2001 Gassler ..... F16B 7/046 403/189
6,223,917 B1 * 5/2001 Bruder ..... A47B 47/0008 403/231
6,837,389 B2 * 1/2005 Gassler ..... E04C 3/06 248/222.12
7,922,417 B2 * 4/2011 Jimenez ..... A47B 47/0083 108/193
8,973,642 B2 * 3/2015 Lawson ..... E04H 1/1272 160/351

(Continued)

FOREIGN PATENT DOCUMENTS

| | | |
|---|---|---|
| DE | 102013010733 | 12/2014 |
| DE | 102016015092 | 6/2017 |
| DE | 202017102447 | 4/2018 |

OTHER PUBLICATIONS

Search Report and Written Opinion in Belgium Application No. 2023/05114, dated Sep. 8, 2023, 12 pages.

*Primary Examiner* — Rodney Mintz
(74) *Attorney, Agent, or Firm* — KDW Firm PLLC

(57) ABSTRACT

A structural system for constructing a stand, such as a promotional stand as used at trade fairs, exhibitions and events. The structural system includes at least two base elements and at least four support elements. The at least two base elements can be releasably connected to the at least four support elements so that, in an assembled state of the structural system, the at least four support elements extend between the two base elements in order to form with the at least two base elements one of a bottom partition and an upper partition of the stand. In a disassembled state of the structural system the at least two base elements and the at least four support elements are stackable.

16 Claims, 5 Drawing Sheets

(56) References Cited

U.S. PATENT DOCUMENTS 9,228,600 B2 * 1/2016 Frey ..... G09F 15/0025
10,533,333 B2 * 1/2020 Shin ..... E04B 1/34315
10,612,233 B1 * 4/2020 Yu ..... E04B 1/34321
11,098,494 B2 * 8/2021 Lesage ..... E04H 1/1272
11,486,157 B2 * 11/2022 Hwang ..... F16B 5/02
11,761,194 B2 * 9/2023 Webb ..... E04B 1/5825
52/79.1
12,054,937 B2 * 8/2024 Baum ..... E04B 1/34861
12,058,821 B2 * 8/2024 Deleu ..... H05K 5/30
12,082,721 B2 * 9/2024 Kurzdorfer ..... G09F 7/20
2003/0089674 A1 * 5/2003 Gassler ..... E04H 1/1272
211/189
2008/0290771 A1 * 11/2008 Jimenez ..... A47B 47/0083
312/263
2011/0290958 A1 * 12/2011 Lawson ..... G09F 15/0068
248/163.1
2015/0292537 A1 * 10/2015 Frey ..... E04C 2/00
52/578
2018/0251974 A1 * 9/2018 Beille ..... E04F 13/005
2019/0301183 A1 * 10/2019 Shin ..... E04H 1/005
2020/0002940 A1 * 1/2020 Jung ..... E04H 1/1272
2020/0131790 A1 * 4/2020 Lesage ..... E04C 3/06
2021/0047851 A1 * 2/2021 Hwang ..... F16B 37/0857
2021/0381223 A1 * 12/2021 Webb ..... E04B 1/388
2022/0346242 A1 * 10/2022 Deleu ..... G09F 9/3026
2023/0015363 A1 * 1/2023 Baum ..... E04B 1/34861
2024/0041229 A1 * 2/2024 Kurzdorfer ..... G09F 15/0012
2024/0288114 A1 * 8/2024 Deleu ..... E04B 1/5831
2024/0336445 A1 * 10/2024 Deleu ..... E04H 1/1272
2024/0381544 A1 * 11/2024 Deleu ..... H05K 5/0018

* cited by examiner

EXHIBITION STAND

CROSS-REFERENCE TO RELATED APPLICATIONS

This application claims priority to pending Belgium patent application serial number 2023/5114, filed Feb. 16, 2023, the entirety of which application is incorporated by reference herein.

FIELD OF THE INVENTION

The invention relates to a structural system for constructing a stand.

BACKGROUND

Exhibition stands are temporary, typically decorative constructions for displaying products and services to people. To make exhibition stands use is typically made of exhibition stand elements as described in BE1020560A3. Constructing exhibition stands with such exhibition stand elements is labour-intensive.

A recent trend in the industry is for containers to be converted into exhibition stands. The industrial look and feel are visually appealing. The robust structure allows strong, fixed structures to be provided on location in relatively simple manner.

Containers are however sizeable and difficult to transport. Containers are not very modular either, and their layout is difficult to modify.

SUMMARY OF THE INVENTION

Embodiments of the invention have the object of providing a structural system which allows a stand to be constructed in simple and robust manner. Further preferred embodiments have the object of increasing the modularity and the construction speed of the structural system.

According to a first aspect a structural system for constructing a stand is provided, for instance a promotional stand as used at trade fairs, exhibitions and events, wherein the structural system comprises at least two base elements and at least four support elements, wherein the at least two base elements can be releasably connected to the at least four support elements so that, in an assembled state of the structural system, the at least four support elements extend between the two base elements in order to form with the at least two base elements one of a bottom partition and an upper partition of the stand; and wherein, in a disassembled state of the structural system, the at least two base elements and the at least four support elements are stackable. In the assembled state the structural system forms a promotional stand of the container type. The dimensions of the structural system preferably correspond with dimensions of a container. The limited number of components, two base elements and four support elements, enables rapid and simple construction of a relatively large structure at a trade show or event. Only eight mutual connections need thus initially be realized in order to construct the structural system. Providing a structural system which is assemblable and disassemblable further enables the structural system to be transported in simple and compact manner from one event to another event.

Further advantages and advantageous effects of the following exemplary embodiments are elucidated in the figure description below.

Each of the at least two base elements preferably comprises a frame which forms a periphery of the base elements. The frame is more preferably formed by at least four elongate structural elements which are each mutually fixedly connected at an outer end to one of the at least four elongate structural elements.

A structural element preferably comprises at least two longitudinal flanges and a longitudinal body extending between the two longitudinal flanges, wherein the two longitudinal flanges extend at least from the same side of the body in a direction substantially perpendicular to the body. In contrast to known container stands, the structural element as described above requires no corrugated walls for strength, and therefore allows for more modularity and creativity in the layout and construction of the stand. In assembled state the at least two longitudinal flanges more preferably extend toward an inner side of the frame.

The at least four support elements are preferably arranged at an inner side of the frame.

At least one of an upper side and lower side of the base elements is preferably provided with a surface such as a covering, a plate, an LED tile, and so on.

The structural system preferably further comprises a corner profile configured to be attached to the base element at at least one peripheral edge of one of the at least two base elements, wherein the corner profile is provided with a first attachment channel which extends in a longitudinal direction of the corner profile and is configured for attachment of external exhibition stand profiles. More preferably, the first attachment channel comprises an opening which is directed away from the base elements, preferably in a substantially vertical direction when the corner profile is attached to the base element.

The corner profile is preferably provided with a second attachment channel extending in a longitudinal direction of the corner profile and configured for attachment of an elastic or resilient element. More preferably, the second attachment channel comprises an opening which is directed away from the base elements, preferably in a substantially vertical direction when the corner profile is attached to the base element, the second attachment channel more preferably lying substantially parallel to the first attachment channel.

The corner profile is preferably provided with a third attachment channel extending in a longitudinal direction of the corner profile and comprising an opening which is oriented in a lateral direction of the base element, when the corner profile is attached to the base element.

The corner profile preferably comprises a base body and edge body, wherein the edge body extends at an outer end of the base body at an angle relative to the base body so that the corner profile forms an inner corner which is provided to connect to an outer corner of the base element.

Preferably, the structural system further comprises a bracket which is attached to the base element and the corner profile comprises a hook part which is provided to be arranged in the bracket.

The corner profile preferably extends over substantially a whole length or width of the base element.

Two corner profiles are preferably provided, wherein a first corner profile is provided on an upper side of the base element and wherein a second corner profile is provided on a lower side of the base element.

In the disassembled state the at least four support elements are preferably nestable in at least one of the at least two base elements or between the at least two base elements.

A length dimension of the base elements is here preferably at least 5.5 m (18 feet), preferably at least 6 m (19.7 feet).

The base elements are preferably provided with attaching means which allow the frame of the base element to be connected to a frame of an adjacent base element of a further structural system.

The corner profiles are preferably at least partially interruptible at the position of an attaching means of the base element so that an attaching bracket can be arranged over the two adjacent frames in order to connect the two mutually adjacent frames to each other.

According to a further aspect, a corner profile configured to be attached to a base element at at least one peripheral edge is provided, wherein the corner profile is provided with a first attachment channel which extends in a longitudinal direction of the corner profile and is configured for attachment of external exhibition stand profiles.

More preferably, the first attachment channel comprises an opening which is directed away from the base elements, preferably in a substantially vertical direction when the corner profile is attached to the base element.

The corner profile is preferably provided with a second attachment channel extending in a longitudinal direction of the corner profile and configured for attachment of an elastic or resilient element.

More preferably, the second attachment channel comprises an opening which is directed away from the base elements, preferably in a substantially vertical direction when the corner profile is attached to the base element, the second attachment channel more preferably lying substantially parallel to the first attachment channel.

The corner profile is preferably provided with a third attachment channel extending in a longitudinal direction of the corner profile and comprising an opening which is oriented in a lateral direction of the base element, when the corner profile is attached to the base element.

The corner profile preferably comprises a base body and edge body, wherein the edge body extends at an outer end of the base body at an angle relative to the base body so that the corner profile forms an inner corner which is provided to connect to an outer corner of the base element.

According to yet another aspect, an assembly of a structural system, an exhibition stand profile and a connecting element is provided, the exhibition stand profile comprising a first side wall, a second side wall and a third side wall which extend in a first direction of the exhibition stand profile, wherein the first side wall and the second side wall lie opposite each other, wherein the third side wall forms a connection between the first side wall and the second side wall, wherein the exhibition stand profile is provided with a first passage extending through the exhibition stand profile from a first opening in the first side wall to a second opening in the second side wall along a second direction which crosses the first direction, wherein the first passage is provided for arranging a connecting element through the exhibition stand profile along the second direction, which connecting element is provided with a first flat side which extends along the second direction and strikes against the second side wall, and is provided at an outer end lying opposite the first flat side with a fixing means configured to attach the exhibition stand profile to the base element, preferably to the attaching means of the corner profile.

BRIEF DESCRIPTION OF THE FIGURES

The above stated and other advantageous features and objects of the invention will become more apparent, and the invention better understood, on the basis of the following detailed description when read in combination with the accompanying drawings, in which.

DETAILED EMBODIMENTS

Figure 1:
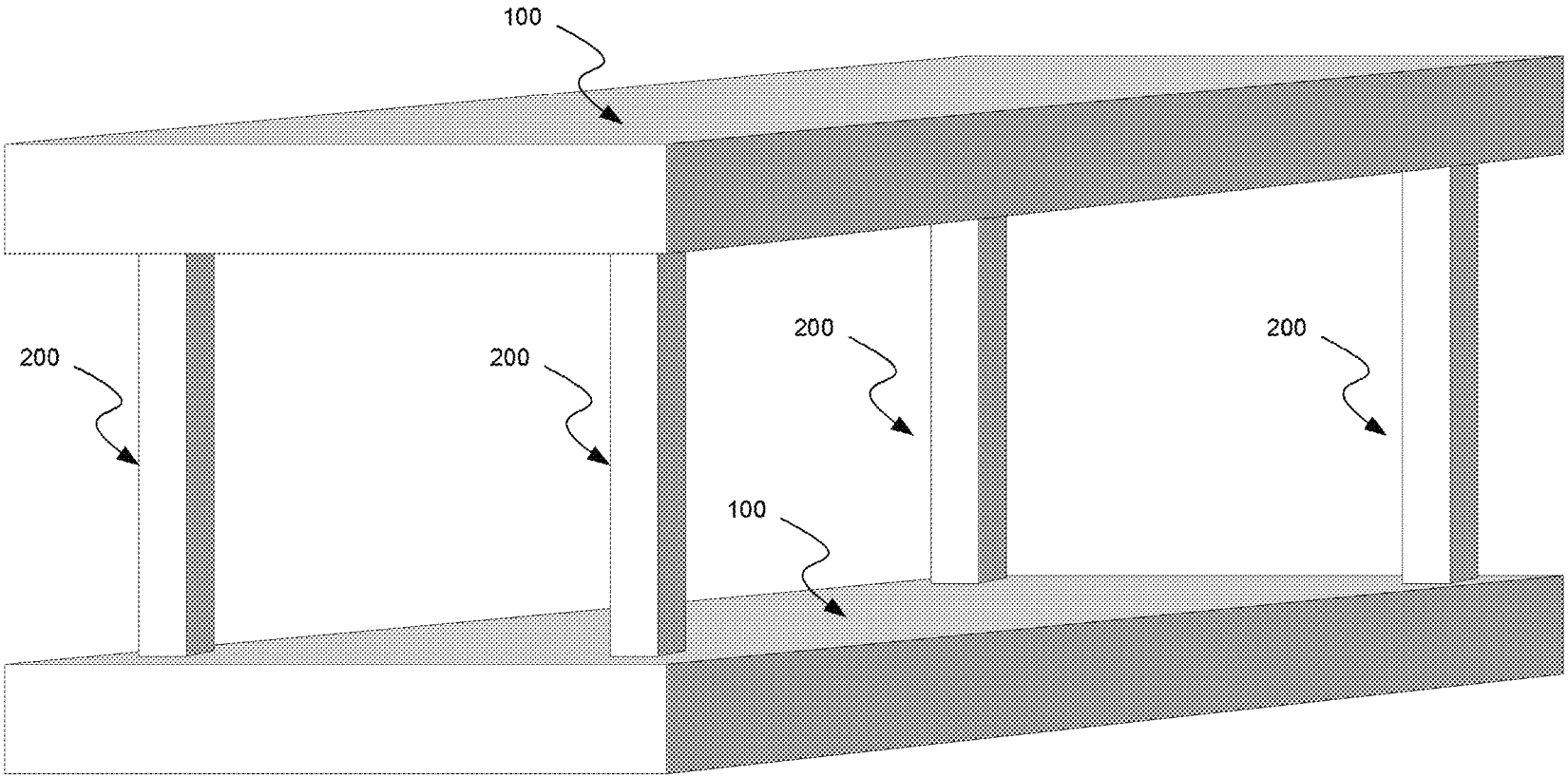
FIG. 1 shows schematically a perspective view of a structural system in assembled state according to an embodiment.

The present invention will be described with reference to specific embodiments. The invention is however not limited thereto, but solely by the claims.

As used here, the singular forms "a" and "the" comprise both the singular and plural references, unless clearly indicated otherwise by the context.

The terms "comprising", "comprises" and "composed of" as used here are synonymous with "including". The terms "comprising", "comprises" and "composed of" when referring to stated components, elements or method steps also comprise embodiments which "consist of" the components, elements or method steps.

The terms first, second, third and so on are further used in the description and in the claims to distinguish between similar elements and not necessarily to describe a sequential or chronological order, unless this is specified. It will be apparent that the thus used terms are mutually interchangeable under appropriate circumstances and that the embodiments of the invention described here can operate in an order other than described or illustrated here.

Reference in this specification to "one embodiment", "an embodiment", "some aspects", "an aspect" or "one aspect" means that a determined feature, structure or characteristic described with reference to the embodiment or aspect is included in at least one embodiment of the present invention. The manifestations of the sentences "in one embodiment", "in an embodiment", "some aspects", "an aspect" or "one aspect" in different places in this specification thus do not necessarily all refer to the same embodiment or aspects. As will be apparent to a skilled person in this field, the specific features, structures or characteristics can further be combined in any suitable manner in one or more embodiments or aspects. Although some embodiments or aspects described here comprise some but no other features which are included in other embodiments or aspects, combinations of features of different embodiments or aspects are further intended to fall within the context of the invention and to form different embodiments or aspects, as would be apparent to the skilled person. In the appended claims all features of the claimed embodiments or aspects can for instance be used in any combination.

The same or similar elements are designated in the figures with the same reference numerals.

In the context of this application a structural system for constructing a stand is defined as a base frame for constructing promotional booths as are regularly used at trade shows, exhibitions, indoor or outdoor events.

FIG. 1 shows schematically a perspective view of a structural system in assembled state according to an exemplary embodiment.

The structural system comprises at least two base elements 100 and at least four support elements 200. The structural system can also be connected to further structural systems, exhibition stand profiles and other finishing materials.

FIG. 1 shows the structural system in assembled state. In the assembled state the structural system can be additionally laid out depending on the wishes of the user. In the assembled state the structural system preferably forms a promotional stand of the container type. This means that the dimensions of the structural system preferably correspond with dimensions of a container, for instance a TEU container. In the assembled state the at least two base elements 100 are connected to the at least four support elements 200. The at least four support elements 200 extend between the two base elements 100 in order to form with the at least two base elements 100 one of a bottom partition and a top partition of the stand. In other words, a first base element 100 of the at least two base elements 100 forms a ceiling and a second base element of the at least two base elements forms a bottom of the structural system. The limited number of components, i.e. two base elements 100 and four support elements 200, enables rapid and simple construction of a relatively large and robust base structure at a trade show or event. Only eight mutual connections need thus initially be realized in order to construct the structural system. The support elements 200 are preferably connected at the position of their outer ends to the base elements 100. The support elements 200 are thus for instance connected at a proximal outer end thereof to the base element 100 and connected at a distal outer end to the second base element 100. The distance between the proximal outer end and the distal outer end substantially equals the intermediate distance of the first and the second base element in the assembled state, for instance 2.5 m (8.2 feet). A length dimension of the base elements is at least 5.5 m (18 feet), preferably at least 6 m (19.7 feet).

Figure 2:
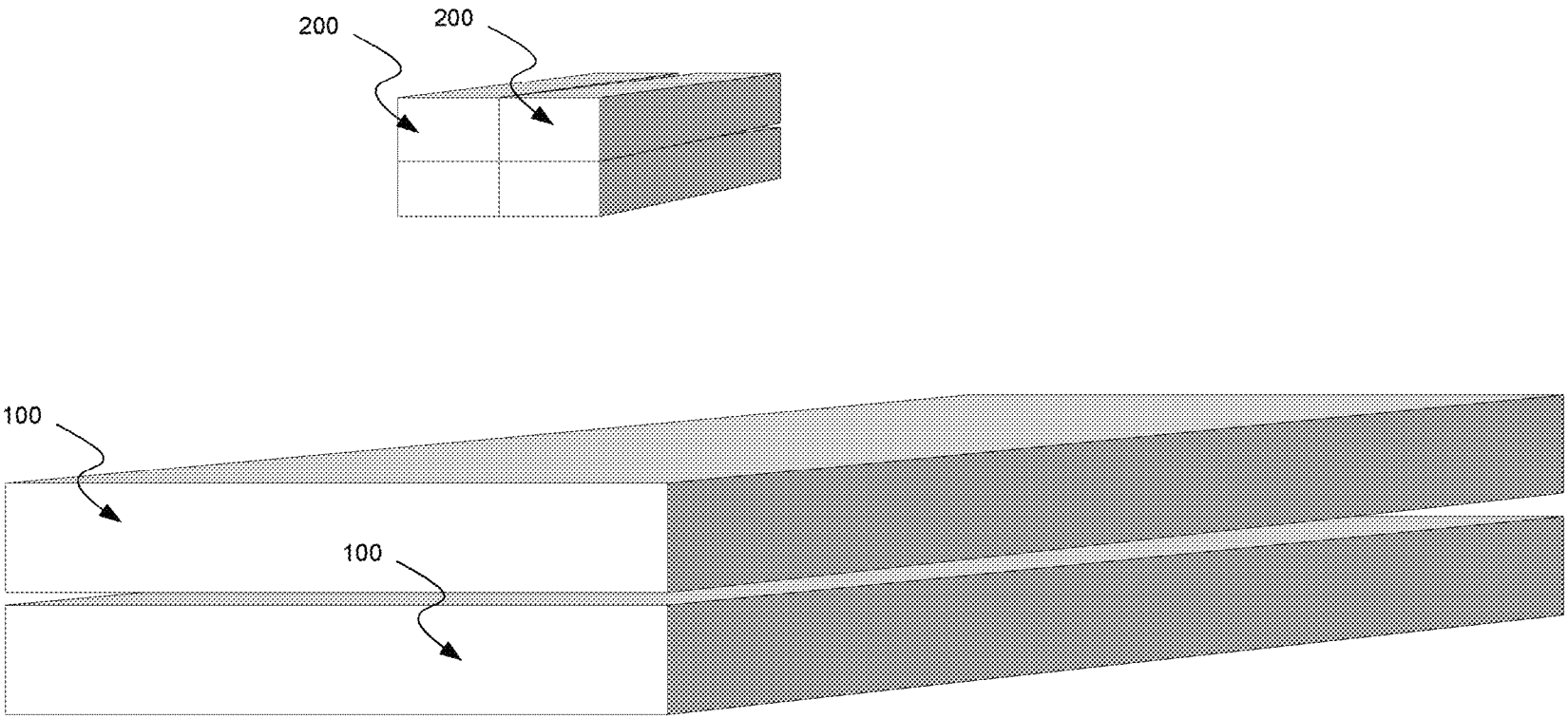
FIG. 2 shows schematically a perspective view of a structural system in disassembled state.

FIG. 2 shows schematically a perspective view of the structural system shown in FIG. 1 in disassembled state. In a disassembled state of the structural system the at least two base elements 100 and the at least four support elements 200 are stackable. This allows the structural system to be transported in simple and compact manner from one event to another event. In the disassembled state the at least four support elements 200 are nestable in at least one of the at least two base elements 100 or between the at least two base elements 100. In this way the structural system forms in disassembled state a self-packaging whole which is transportable in simple manner. The compactness of the structural system in disassembled state allows a plurality of structural systems of the container type to be transported on one trailer of a cargo vehicle. Compared to known container stands, a plurality of, for instance four or five structural systems, can thus in disassembled state be stacked one on the other and be transported within the same footprint as one container stand as known from the prior art.

Figure 3:
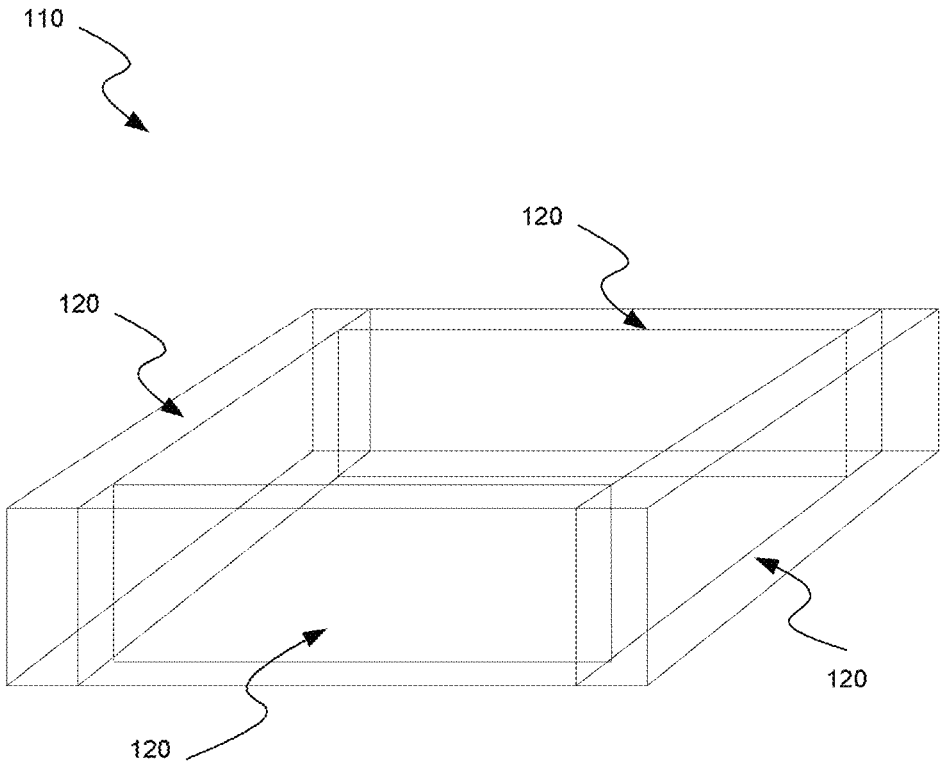
FIG. 3 shows schematically a frame of the base elements according to an exemplary embodiment.

FIG. 3 shows schematically a frame of the base elements 200 according to an exemplary embodiment. As shown in FIG. 3, the base element 110 comprises a frame which forms a periphery of the base element 100. A space in the frame is preferably hollow and can be filled at least partially with for instance a latticework in order to make base elements 200 more robust and rigid. The space also allows further construction elements to be arranged. At least one of an upper side and lower side of the base elements can thus be provided with a surface such as a covering, a plate, an LED tile, and so on. When the frame 110 is used as frame for a lower base element, an upper side of the frame can comprise a ground covering. Alternatively or in combination, the covering can be an LED floor wherein the surface is formed at least partially from LED tiles. The space in the frame can be used to accommodate control systems such as control electronics or cables. The frame 110 is preferably formed by at least four elongate structural elements 120 which are each mutually fixedly connected at an outer end to one of the at least four elongate structural elements 120. At the position of the mutual connection between two structural elements 120 a corner of the frame and furthermore of the base element is formed. Two structural elements 120 are preferably connected to each other in mitred manner. The at least four support elements are preferably arranged at an inner side of the frame. In this way an outer wall of the base element is formed by the structural elements 120. There is thus a space between the outer wall and the support elements, which can be utilized for construction of external construction elements, such as exhibition stand profiles. A plurality of structural systems can also be provided. The plurality of structural systems can be mutually connected. The base elements are provided here with attaching means which allow the frame of the base element to be connected to a frame of an adjacent base element of a further structural system. At the position of an attaching means of the base element the corner profiles are at least partially interruptible so that an attaching bracket can be arranged over the two adjacent frames in order to connect the two mutually adjacent frames to each other.

Figure 4:
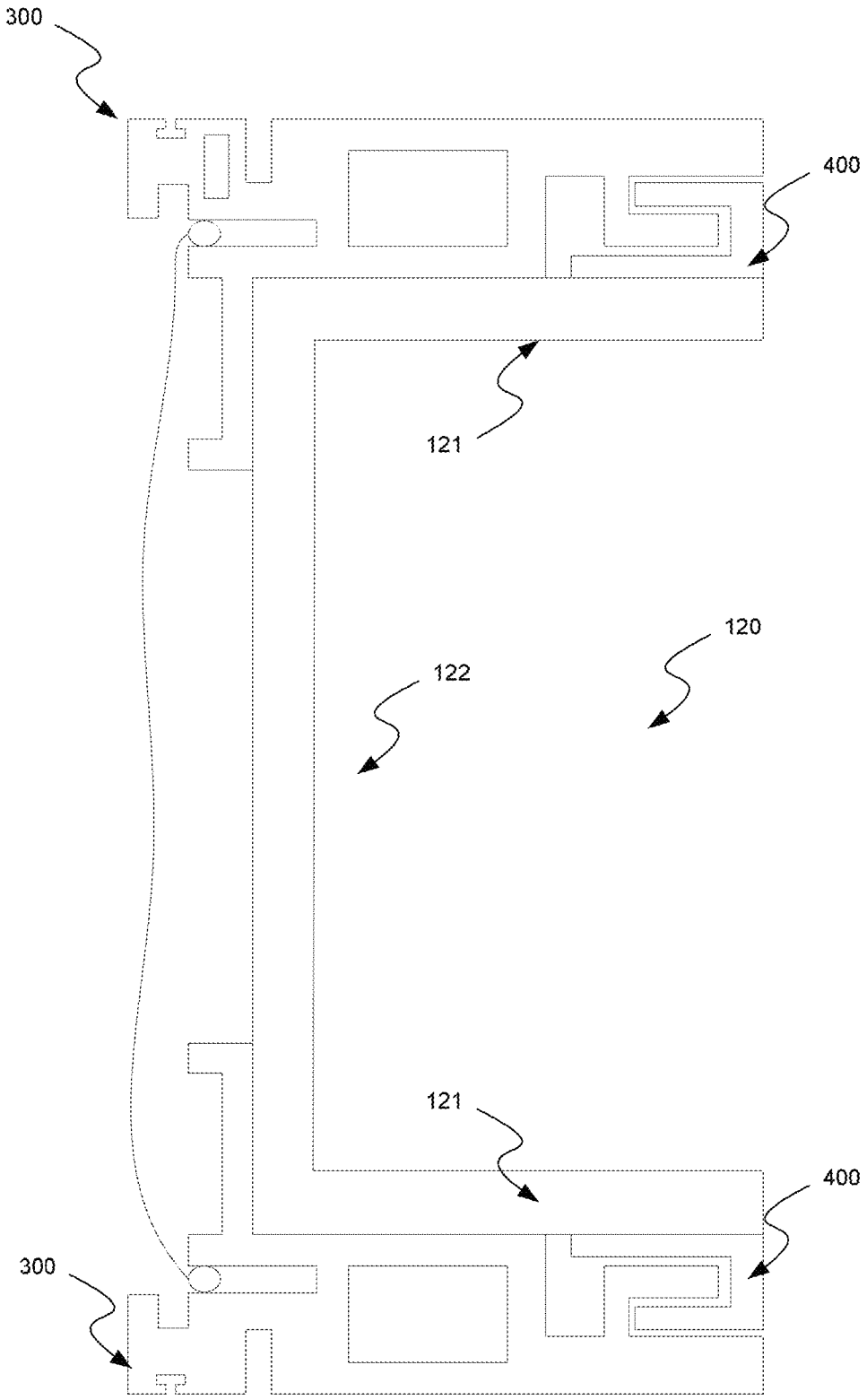
FIG. 4 shows a cross-section of a structural element and two corner profiles according to an exemplary embodiment.

FIG. 4 shows a cross-section of a structural element 120 and two corner profiles 300 according to an exemplary embodiment connected thereto. The shown structural element 120 can be applied in the frame 110 according to FIG. 2 in order to form the periphery of the base element. Two brackets 400 are further shown, which can be provided according to an exemplary embodiment to attach corner profile 300 to structural element 120 in simple manner.

According to the exemplary embodiment shown in FIG. 4, structural element 120 comprises at least two longitudinal flanges 121 and a longitudinal body 122 extending between the two longitudinal flanges 121. Longitudinal is understood to mean a longitudinal direction of the elongate structural elements. Flanges 121 and body 122 extend over the whole length of structural element 120. This allows the structural element 120 to be produced using extrusion, preferably from steel. The two longitudinal flanges 121 extend at least from the same side of body 122 in a direction substantially perpendicular to body 122. In this way a so-called C-profile is formed, which is robust and rigid yet has a relatively low weight. This enables length dimensions of about 5.5 m (18 feet) or even 6 m (19.7 feet) to be bridged without additional support elements or framework in upright walls of the structural system. In the context of the frame it is preferred for the flanges 121 to be directed toward an inner side of the frame so that the body 122 forms the substantially vertically oriented peripheral wall of the base element 100.

As shown in FIG. 4, the structural system preferably comprises a corner profile 300 which is configured to be attached to base element 100 at the position of at least one peripheral edge of one of the at least two base elements 100. According to the illustrated exemplary embodiment, the corner profiles are arranged on the longitudinal flanges 121. The corner profiles are arranged at the position of the peripheral edge, between flanges 121 and body 122. Corner profile 300 is provided with an attaching means configured to attach external exhibition stand profiles to the corner profile, as will be further elucidated with reference to FIG. 5.

The corner profile 300 can be arranged on both the upper side and the lower side of structural element 120. In order to simplify assembly onto structural element 120 a bracket 400 to which corner profile 300 can be correspondingly coupled can be provided. The bracket 400 is U-shaped and provided at the position of an inner side of the structural element, as seen in assembled state. In order to further elucidate the functionalities and features of corner profile 300 reference is then made to FIG. 5.

Figure 5:
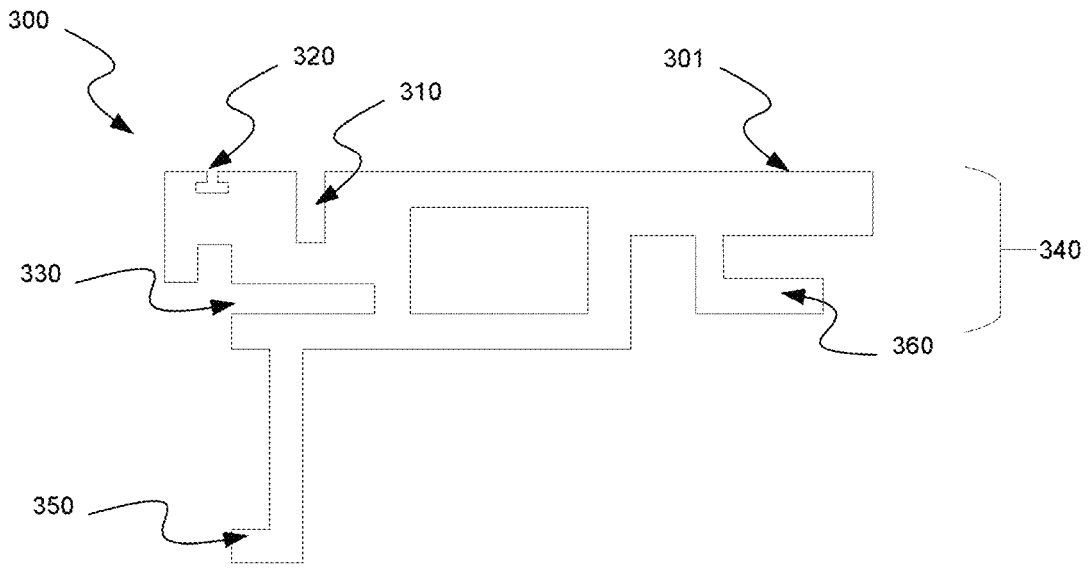
FIG. 5 shows an enlargement of the corner profiles shown in FIG. 4.

FIG. 5 shows an enlargement of the corner profiles shown in FIG. 4. As shown in FIG. 4, the corner profile 300 is configured to be attached to a base element at the position of at least one peripheral edge. Corner profile 300 is provided with a first attaching means 310 which is configured to attach external exhibition stand profiles (not shown). The attaching means 310 is preferably an attachment channel 310 which extends in a longitudinal direction of the corner profile. Providing corner profile 300 enables a further exhibition stand profile to be coupled to the base element in simple manner. An exhibition stand profile comprises a first side wall, a second side wall and a third side wall which extend in a first direction of the exhibition stand profile. The first side wall and the second side wall are located opposite each other. The third side wall forms a connection between the first side wall and the second side wall. The exhibition stand profile is further provided with a first passage extending through the exhibition stand profile from a first opening in the first side wall to a second opening in the second side wall along a second direction which crosses the first direction. The first passage is provided for arranging a connecting element through the exhibition stand profile. The connecting element is provided with a first flat side extending along the second direction and striking against the second side wall, and is provided at an outer end lying opposite the first flat side with a fixing means configured to attach the exhibition stand profile to the base element, preferably to the attaching means of corner profile 300. The fixing means can be a screw thread which engages in the walls of the attachment channel.

The first attachment channel 310 comprises an opening along which the fixing means of an external exhibition stand profile can be introduced into the channel. The opening is directed away from the base elements, preferably in a substantially vertical direction when the corner profile is attached to the base element. The advantage hereof is based on the insight that exhibition stand profiles which are attached to corner profile 300 are typically structural elements with a lying orientation of a wall formed with the exhibition stand profiles. The vertical orientation of the opening and the channel allows attachment channel 310 to be easily accessible and allows the stand to be assembled more quickly. Attachment channel 310 preferably extends in a length direction, also referred to as longitudinal direction, of corner profile 300.

Corner profile 300 can further be provided with a second attachment channel 320 extending in a longitudinal direction of the corner profile and configured for attachment of an elastic or resilient element. The second attachment channel 320 lies at a distance from the first attachment channel 310 and is preferably parallel. Second attachment channel 320 allows an elastic or resilient element to be mounted so that, when an exhibition stand profile is mounted via the first attachment channel 210 onto corner profile 300, the elastic or resilient element functions as damper between the exhibition stand profile and corner profile 300. Second attachment channel 320 preferably comprises an opening which is directed away from the base elements, preferably in a substantially vertical direction when the corner profile is attached to the base element. In this way the two attachment channels are oriented in substantially the same direction, thus further improving assembly of the exhibition stand profiles.

Corner profile 300 can further be provided with a third attachment channel 330 extending in a longitudinal direction of the corner profile and comprising an opening which is oriented in a lateral direction of the base element, when the corner profile is attached to the base element. The third attachment channel 330 is oriented at right angles to the first and the second attachment channel 310, 320. In this way the third attachment channel 330 is directed outward and the third attachment channel 330 is located at the position of the body 122. This enables the peripheral wall of the base element to be covered with for instance a cloth or a plate. The cloth can for instance be secured in the third attachment channel 330 with a wire, be pulled over the peripheral wall of a base element and be attached to a further corner profile 300 mounted on a further side, as shown in FIG. 4.

In order to simplify mounting of corner profile 300 the corner profile 300 comprises a base body 340 and edge body 350, wherein the edge body extends at the position of an outer end of the base body at an angle relative to the base body so that the corner profile forms an inner corner which is provided to connect to an outer corner of the base element. Such an exemplary embodiment is shown in FIG. 4.

Corner profile 300 is not provided exclusively to connect exhibition stand profiles. Corner profile 300 can also be used to mount a railing or stairs so that a user is safely able to move onto a base element or move from and to a base element at a higher level.

The skilled person will appreciate on the basis of the above description that the invention can be embodied in different ways and on the basis of different principles. The invention is not limited here to the above described embodiments. The above described embodiments and the figures are purely illustrative and serve only to increase understanding of the invention. The invention will not therefore be limited to the embodiments described herein, but is defined in the claims.

The invention claimed is:

1. A structural system for constructing a stand, the structural system comprising:

at least two base elements and at least four support elements, wherein the at least two base elements are releasably connected to the at least four support elements so that, in an assembled state of the structural system, the at least four support elements extend between the two base elements in order to form with the at least two base elements one of a bottom partition and an upper partition of the stand; and wherein, in a disassembled state of the structural system, the at least two base elements and the at least four support elements are stackable;

wherein the structural system further comprises a corner profile configured to be attached to a respective said base element on at least one peripheral edge of the respective base element, wherein the corner profile is provided with a first attaching means which is configured to attach external exhibition stand profiles to the corner profile, wherein the first attaching means is a first attachment channel extending in a longitudinal direction of the corner profile and configured to attach the external exhibition stand profiles, and wherein the first attachment channel comprises a first opening which is directed away from the base elements.

2. The structural system according to claim 1, wherein the corner profile is provided with a third attachment channel extending in the longitudinal direction of the corner profile and comprising a third opening which is oriented in a lateral direction of the respective base element, when the corner profile is attached to the respective base element.

3. The structural system according to claim 1, wherein the corner profile comprises a base body and edge body, wherein the edge body extends at an outer end of the base body at an angle relative to the base body so that the corner profile forms an inner corner which is provided to connect to an outer corner of the respective base element.

4. The structural system according to claim 1, further comprising a bracket which is attached to the respective base element; and wherein the corner profile comprises a hook part which is provided to be arranged in the bracket.

5. The structural system according to claim 1, wherein the corner profile extends over substantially a whole length or width of the respective base element.

6. The structural system according to claim 1, wherein two corner profiles are provided, wherein a first corner profile is provided on an upper side of the respective base element and wherein a second corner profile is provided on a lower side of the respective base element.

7. The structural system according to claim 1, wherein in the disassembled state the at least four support elements are nestable in at least one of the at least two base elements or between the at least two base elements.

8. The structural system according to claim 1, wherein the corner profile is provided with a second attachment channel extending in the longitudinal direction of the corner profile and configured for attachment of an elastic or resilient element.

9. The structural system according to claim 8, wherein the second attachment channel comprises a second opening which is directed away from the base elements.

10. The structural system according to claim 1, wherein each of the at least two base elements comprises a frame which forms a periphery of the base elements.

11. The structural system according to claim 10, wherein the at least four support elements are arranged at an inner side of the frame.

12. The structural system according to claim 10, wherein at least one of an upper side and lower side of the base elements is provided with a covering, a plate, or an LED tile.

13. The structural system according to claim 10, wherein the base elements are provided with a second attaching means which allow the frame of the base elements to be connected to a frame and corner profile of an adjacent base element of a further structural system, wherein, optionally, the corner profiles are at least partially interruptible at a position of the second attaching means of the base elements such that an attaching bracket arranged over the two adjacent frames connects the two adjacent frames to each other.

14. The structural system according to claim 10, wherein the frame is formed by at least four elongate structural elements which are each mutually fixedly connected at an outer end to one of the at least four elongate structural elements.

15. The structural system according to claim 14, wherein at least one of said structural elements comprises at least two longitudinal flanges and a longitudinal body extending between the two longitudinal flanges, and wherein the two longitudinal flanges extend at least from a same side of the body in a direction substantially perpendicular to the body.

16. The structural system according to claim 15, wherein in the assembled state the at least two longitudinal flanges extend toward an inner side of the frame.

* * * * *